US010089919B2

(12) United States Patent
Zhao

(10) Patent No.: US 10,089,919 B2
(45) Date of Patent: Oct. 2, 2018

(54) SCANNING DRIVING CIRCUITS

(71) Applicant: Wuhan China Star Optoelectronics Technology Co., Ltd., Wuhan, Hubei (CN)

(72) Inventor: Mang Zhao, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 147 days.

(21) Appl. No.: 15/316,158

(22) PCT Filed: Nov. 16, 2016

(86) PCT No.: PCT/CN2016/106042
§ 371 (c)(1),
(2) Date: Dec. 2, 2016

(87) PCT Pub. No.: WO2018/035995
PCT Pub. Date: Mar. 1, 2018

(65) Prior Publication Data

US 2018/0190181 A1 Jul. 5, 2018

(30) Foreign Application Priority Data

Aug. 24, 2016 (CN) ..... 2016 1 0718554

(51) Int. Cl.
*G09G 3/20* (2006.01)

(52) U.S. Cl.
CPC ... *G09G 3/2096* (2013.01); *G09G 2310/0283* (2013.01); *G09G 2310/067* (2013.01)

(58) Field of Classification Search
None
See application file for complete search history.

(56) References Cited

U.S. PATENT DOCUMENTS

2005/0174312 A1* 8/2005 Choi ..... G09G 3/2096 345/88
2006/0277399 A1* 12/2006 Sakamaki ..... G06F 13/4013 712/300

* cited by examiner

*Primary Examiner* — Sejoon Ahn
(74) *Attorney, Agent, or Firm* — Andrew C. Cheng

(57) ABSTRACT

The present disclosure relates to a scanning driving circuit including a plurality of cascaded-connected scanning driving units. Each of the scanning driving unit includes a forward-backward scanning circuit, a first and a second input circuit outputting first and second input signals; a pull-down circuit outputting first or second pull-down signals and pulling down or charging a first pull-down control signal point or a second pull-down control signal point; a first and a second control circuit charging or pulling down the first pull-down control signal point or the second pull-down control signal point; and the first and the second output circuit generating the first and the second scanning driving signals for the first and the second scanning line to drive pixel cells.

5 Claims, 7 Drawing Sheets

SCANNING DRIVING CIRCUITS

BACKGROUND OF THE INVENTION

1. Field of the Invention

The present disclosure relates to display technology, and more particularly to a scanning driving circuit.

2. Discussion of the Related Art

Currently, scanning driving circuits are adopted in flat displays, that is, the manufacturing process of thin film transistors (TFT) flat displays is adopted to configure the scanning driving circuit on an array substrate to realize the driving method conducted row by row. Generally, each of the scanning driving units can only drive one scanning line, and each of the scanning driving units has to be configured with a pull-down module to control the pull-down control signal point. A plurality of scanning driving units are provided due to the plurality of scanning lines. Thus, a plurality of pull-down modules have to be configured, which may result in loading and greater power consumption of clock signals.

SUMMARY

The present disclosure relates to a scanning driving circuit for reducing the loading and the power consumption of the clock signals.

In one aspect, a scanning driving circuit includes: a plurality of cascaded-connected scanning driving units, and each of the scanning driving circuit includes: a forward-backward scanning circuit configured to receive a first scanning control voltage, a second scanning control voltage, driving signals, first clock signals, second clock signals, first scanning driving signals, second scanning driving signals, and down-level scanning driving signals to output forward-backward control signals to control the scanning driving circuit to conduct a forward scanning or a backward scanning; a first input circuit configured to receive third clock signals and to receive the forward-backward control signals from the forward-backward scanning circuit to output first input signals; a second input circuit configured to receive fourth clock signals and to receive the forward-backward control signals from the forward-backward scanning circuit to output second input signals; a pull-down circuit configured to receive the forward-backward control signals and the first input signals, to output first pull-down signals, and to pull-down or charge a first pull-down control signal point, or the pull-down circuit is configured to receive the forward-backward control signals and the second input signals, to output second pull-down signals, and to pull-down or charge a second pull-down control signal point; a first control circuit configured to receive the first input signals from the first input circuit and to charge the first pull-up control signal point in accordance with the first input signals, or is configured to receive the first pull-down signals from the pull-down circuit and to pull down the first pull-up control signal point in accordance with the first pull-down signals; a second control circuit configured to receive the second input signals from the second input circuit and to charge a second pull-up control signal point in accordance with the second input signals, or is configured to receive the second pull-down signals from the pull-down circuit and to pull down the second pull-up control signal point in accordance with the second pull-down signals; a first output circuit configured to receive fourth clock signals and to generate first scanning driving signals in accordance with the fourth clock signals, and the first scanning driving signals are outputted to the first scanning line to drive pixel cells; and a second output circuit configured to receive third clock signals and to generate second scanning driving signals in accordance with the third clock signals, and the second scanning driving signals are outputted to the second scanning line to drive the pixel cells.

Wherein the forward-backward scanning circuit includes a first to sixth controllable transistors (T1-T6), a control end of the first controllable transistor (T1) receives the first scanning control voltage (U2D), a first end of the first controllable transistor (T1) receives the driving signals (STV), a second end of the first controllable transistor (T1) connects to a second end of a second controllable transistor (T2) and the first input circuit, a first end of the second controllable transistor (T2) connects to the second scanning line to receive the second scanning driving signals, a control end of the second controllable transistor (T2) connects to a control end of the third controllable transistor (T3) and receives the second scanning control voltage (D2U), a first end of the third controllable transistor (T3) receives the first clock signals, a second end of the third controllable transistor (T3) connects to a second end of the fourth controllable transistor (T4) and the pull-down circuit, a first end of the fourth controllable transistor (T4) receives the second clock signals, a control end of the fourth controllable transistor (T4) connects to a control end of the fifth controllable transistor (T5) and receives the first scanning control voltage (U2D), a first end of the fifth controllable transistor (T5) connects to the first scanning line to receive the first scanning driving signals, a second end of the fifth controllable transistor (T5) connects to a second end of the sixth controllable transistor (T6) and the second input circuit, a first end of the sixth controllable transistor (T6) connects to the scanning line at a down level to receive the scanning driving signals from the down level, and a control end of the sixth controllable transistor (T6) receives the second scanning control voltage (D2U).

Wherein the first input circuit includes a seventh controllable transistor (T7), a control end of the seventh controllable transistor (T7) receives the third clock signals, a first end of the seventh controllable transistor (T7) connects to the second end of the first controllable transistor (T1) and the second end of the second controllable transistor (T2), and a second end of the seventh controllable transistor (T7) connects to the pull-down circuit and the first control circuit.

Wherein the pull-down circuit includes eighth to fifteenth controllable transistor (T8-T15), a first capacitor (C1), and a second capacitor (C2), a control end of the eighth controllable transistor (T8) connects to the second end of the seventh controllable transistor (T7), a first end of the ninth controllable transistor (T9) and the first control circuit, a first end of the eighth controllable transistor (T8) receives turn-off voltage end signals (VGL), a second end of the eighth controllable transistor (T8) connects to a control end of a ninth controllable transistor (T9), a control end of the tenth controllable transistor (T10), a control end of the fourteenth controllable transistor (T14), a control end of the fifteenth controllable transistor (T15), a first end of the thirteenth controllable transistor (T13), a second end of the eleventh controllable transistor (T11), and a first end of the twelfth controllable transistor (T12), a second end of the ninth controllable transistor (T9) connects to the first end of the tenth controllable transistor (T10), the second end of the fourteenth controllable transistor (T14), and the first end of the fifteenth controllable transistor (T15) to receive the turn-off voltage end signals (VGL), the second end of the tenth controllable transistor (T10) connects to the control end of the thirteenth controllable transistor (T13), the second input circuit, and the second control circuit, the first end of the eleventh controllable transistor (T11) receives turn-on voltage end signals (VGH), the control end of the eleventh controllable transistor (T11) connects to the control end of the twelfth controllable transistor (T12), the second end of the third controllable transistor (T3), and the second end of the fourth controllable transistor (T4), the second end of the twelfth controllable transistor (T12) receives the turn-on voltage end signals (VGH), the control end of the thirteenth controllable transistor (T13) connects to the second input circuit, the second control circuit, and the second end of the tenth controllable transistor (T10), the second end of the thirteenth controllable transistor (T13) receives the turn-off voltage end signals (VGL), the first end of the fourteenth controllable transistor (T14) connects to the first output circuit, the second end of the fifteenth controllable transistor (T15) connects to the second output circuit, the first capacitor (C1) connects between the first end and the second end of the eleventh controllable transistor (T11), and the second capacitor (C2) connects between the first end and the second end of the twelfth controllable transistor (T12).

Wherein the first control circuit includes a sixteenth controllable transistor (T16), a control end of the sixteenth controllable transistor (T16) receives the turn-on voltage end signals (VGH), a first end of the sixteenth controllable transistor (T16) connects to the second end of the seventh controllable transistor (T7), the control end of the eighth controllable transistor (T8), and the first end of the ninth controllable transistor (T9), a second end of the sixteenth controllable transistor (T16) connects to the first output circuit.

Wherein the first output circuit includes a seventeenth controllable transistor (T17) and a third capacitor (C3), a control end of the seventeenth controllable transistor (T17) connects to the second end of the sixteenth controllable transistor (T16), a first end of the seventeenth controllable transistor (T17) receives fourth clock signals, a second end of the seventeenth controllable transistor (T17) connects to the first scanning line and the first end of the fourteenth controllable transistor (T14), and the third capacitor (C3) connects between the control end and the second end of the seventeenth controllable transistor (T17).

Wherein the second input circuit includes an eighteenth controllable transistor (T18), a control end of the eighteenth controllable transistor (T18) receives the fourth clock signals, a first end of the eighteenth controllable transistor (T18) connects to the second end of the fifth controllable transistor (T5) and the second end of the sixth controllable transistor (T6), a second end of the eighteenth controllable transistor (T18) connects to the control end of the thirteenth controllable transistor (T13), and the second end of the tenth controllable transistor (T10), and the second control circuit.

Wherein the second control circuit includes a nineteenth controllable transistor (T19), a control end of the nineteenth controllable transistor (T19) receives the turn-on voltage end signals (VGH), the first end of the nineteenth controllable transistor (T19) connects to the second end of the tenth controllable transistor (T10), the control end of the thirteenth controllable transistor (T13), and the second end of the eighteenth controllable transistor (T18), and a second end of the nineteenth controllable transistor (T19) connects to the second output circuit.

Wherein the second output circuit includes a twentieth controllable transistor (T20) and a fourth capacitor (C4), a control end of the twentieth controllable transistor (T20) connects to the second end of the nineteenth controllable transistor (T19), a first end of the twentieth controllable transistor (T20) connects to the second scanning line and the second end of the fifteenth controllable transistor (T15), a second end of the twentieth controllable transistor (T20) receives the third clock signals, and the fourth capacitor (C4) connects between the control end and the first end of the twentieth controllable transistor (T20).

Wherein the first to the twentieth controllable transistors (T1-T2) are N-type thin film transistors (TFTs), the control ends, the first ends, and the second ends of the first to the twentieth controllable transistors (T1-T20) respectively correspond to a gate, a drain, and a source of the N-type TFTs, or the first to the twentieth controllable transistors (T1-T2) are P-type TFTs, the control ends, the first ends, and the second ends of the first to the twentieth controllable transistors (T1-T20) respectively correspond to a gate, a drain, and a source of the P-type TFTs.

In view of the above, the scanning driving circuit may be forward scanned or backward scanned via the forward-backward scanning circuit. The first input circuit, the second input circuit, the first control circuit, and the second control circuit are adopted to charge the first pull-down control signal point and the second pull-down control signal point. In addition, a pull-down circuit is configured to perform the pull-down control to the first pull-down control signal point and the second pull-down control signal point. The first output circuit and the second output circuit outputs the first and the second scanning driving signals to the first and the second scanning lines to drive corresponding pixel cells. In this way, the loading and the power consumption of the clock signals are reduced.

DETAILED DESCRIPTION OF THE EMBODIMENTS

Embodiments of the invention will now be described more fully hereinafter with reference to the accompanying drawings, in which embodiments of the invention are shown.

Figure 1:
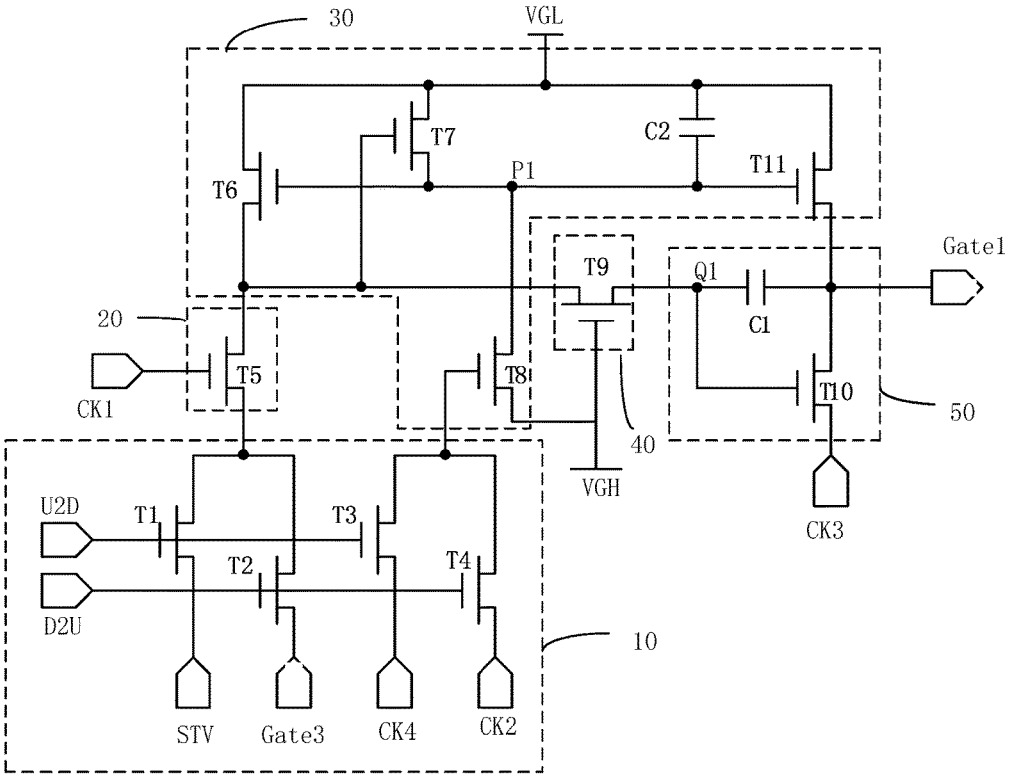
FIG 1(Prior Art)
FIG. 1 is a circuit diagram of one scanning driving units of one conventional scanning driving circuit.

Referring to FIG. 1, the conventional flat display includes a plurality of scanning lines, and thus the scanning driving units corresponding to the scanning lines have to be configured. Each of the scanning driving units can only drive one scanning line. Each of the scanning driving units includes a forward-backward scanning circuit 10, an input circuit 20, a pull-down circuit 30, a control circuit 40, and an output circuit 50, wherein each of the scanning driving units includes a pull-down circuit for controlling a pull-down control signal point (P1), which results in greater loading and greater power consumption of the clock signals (CK2, CK4).

Figure 2:
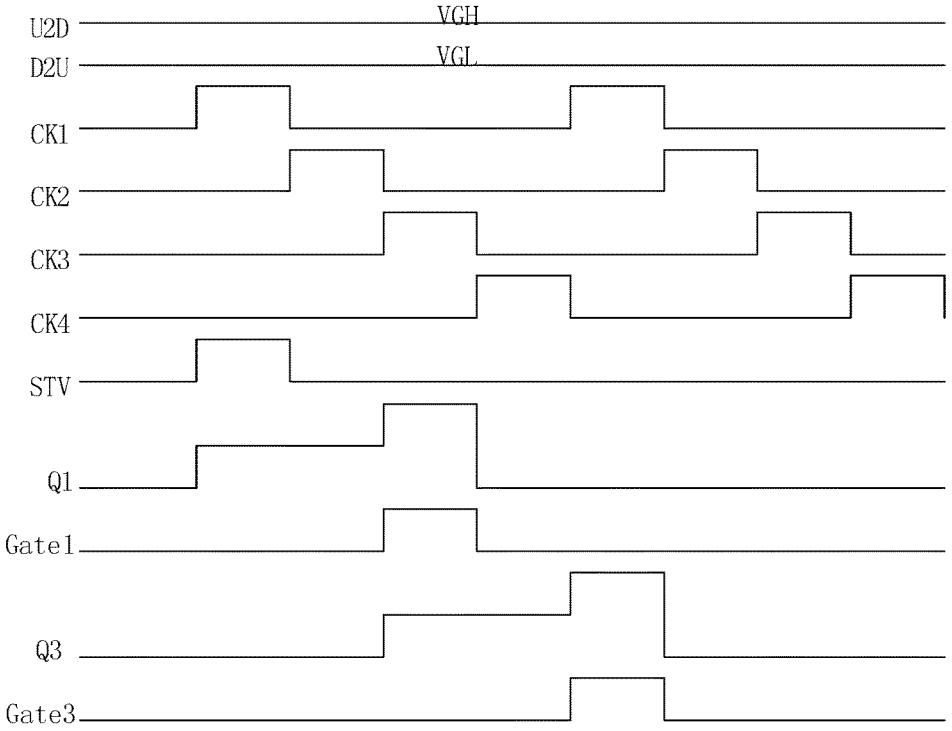
FIG 2(Prior Art)
FIG. 2 is an operational timing diagram of one conventional scanning driving unit.

FIG. 2 is an operational timing diagram of one conventional scanning driving unit. When a first scanning control voltage (U2D) is at a high level and a second scanning control voltage (D2U) is at a low level, the transistor (T1) and the transistor (T3) are turned on and the scanning driving circuit is in a positive-scanning state. When the third clock signals (CK1) are at the high level, driving signals (STV) charges the first pull-up control signal point (Q1) via the transistors (T1, T5, and T9). The first pull-up control signal point (Q1) is charged until reaching the high level, and the capacitor (C1) is maintained at the high level. At the same time, the transistor (T7) is turned on to apply a pull-down control toward the first pull-down control signal point (P1), and the capacitor (C2) is maintained at the low level. At this moment, the transistors (T6, T11) are in an off state. When the clock signals (CK3) are at the high level, the scanning line (Gate1) outputs the high level signals to generate the scanning driving signals for a current level. When the clock signals (CK3) transit to the low level, the clock signals (CK4) reach the high level, the transistor (T8) is turned on, the pull-down control signal point (P1) is charged until reaching the high level, and the capacitor (C2) is maintained at the high level. Afterward, the transistors (T6, T11) are turned on, the pull-up control signal point (Q1) is pulled down to be at the low level, the output signals of the scanning line (Gate1) are pulled down to be at the low level, and the circuit is in a stable state.

When the first scanning control voltage (U2D) is at the low level and the second scanning control voltage (D2U) is at the high level, the transistors (T2, T4) are turned on and the scanning driving circuit is in a backward-scanning state. When the clock signals (CK1) are at the high level, scanning driving signals (Gate3) charges the pull-up control signal point (Q1) via the transistors (T2, T5, and T9). The pull-up control signal point (Q1) is charged until reaching the high level, and the capacitor (C1) is maintained at the high level. At the same time, the transistor (T7) is turned on to apply a pull-down control toward the pull-down control signal point (P1), and the capacitor (C2) is maintained at the low level. At this moment, the transistors (T6, T11) are in the off state. When the clock signals (CK3) are at the high level, the scanning line (Gate1) outputs the high level signals to generate the scanning driving signals for the current level. When the clock signals (CK3) transit to the low level, the clock signals (CK2) reach the high level, the transistor (T8) is turned on, the pull-down control signal point (P1) is charged until reaching the high level, and the capacitor (C2) is maintained at the high level. Afterward, the transistors (T6, T11) are turned on, the scanning line (Gate1) is pulled down to be at the low level, the output signals of the scanning line (Gate1) are pulled down to be at the low level, and the circuit is in a stable state. The operational principles of the scanning driving circuit are similar to the above, and thus are omitted hereinafter.

Figure 3:
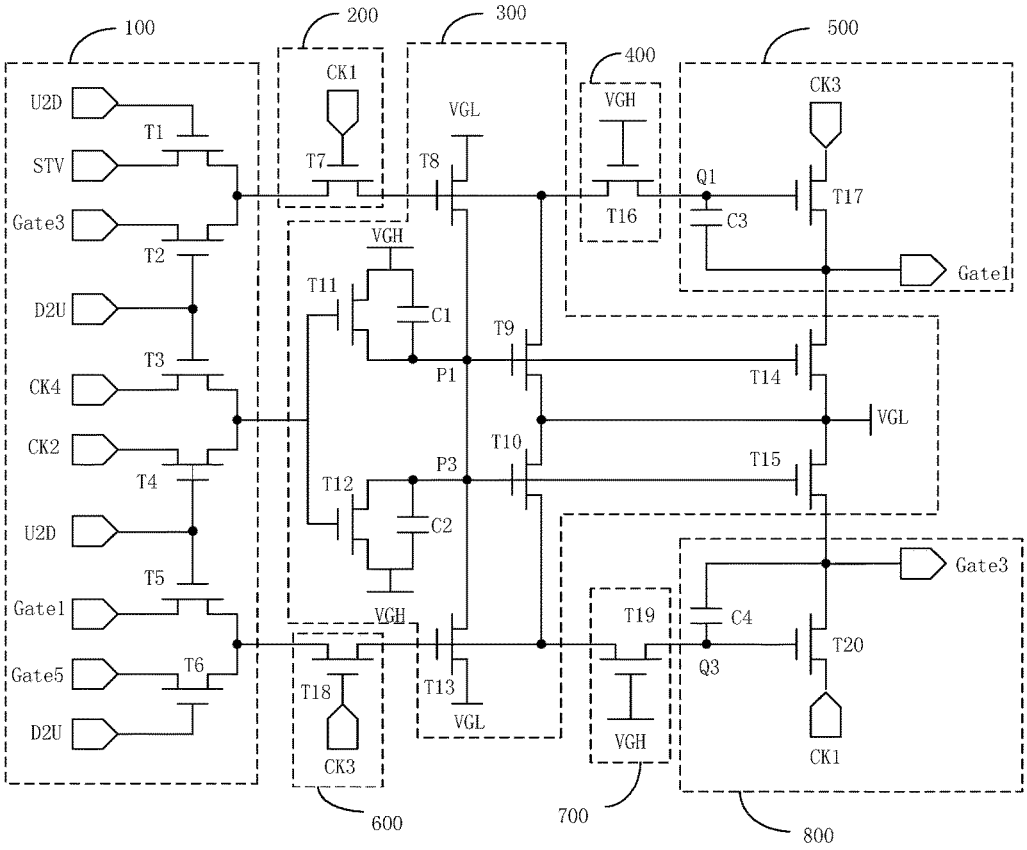
FIG. 3 is a circuit diagram of the scanning driving unit of the scanning driving circuit in accordance with a first embodiment.
Figure 4:
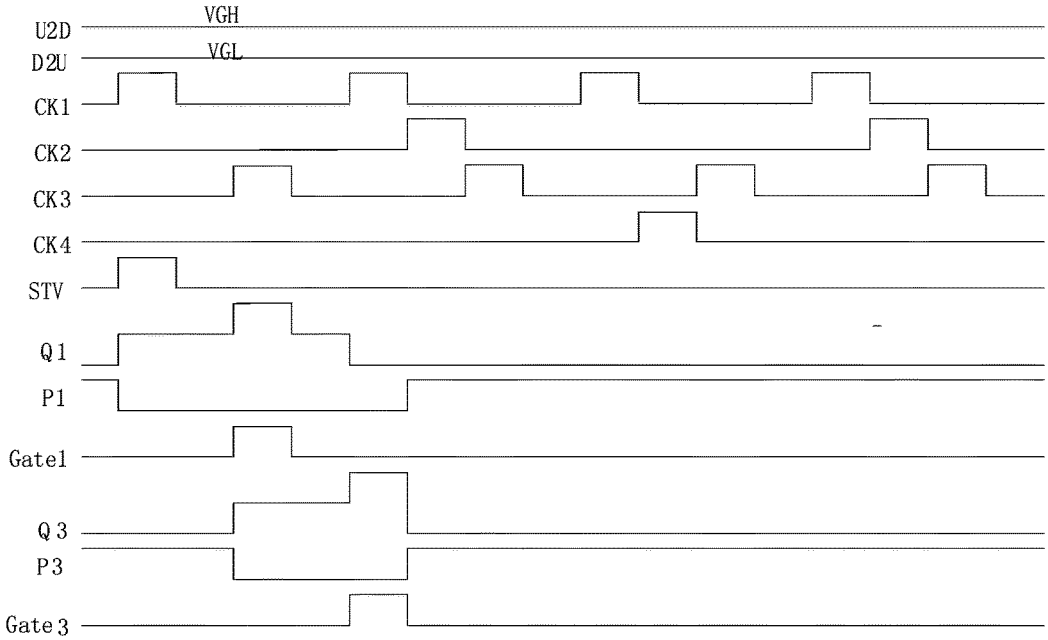
FIG. 4 is a forward-operational timing diagram of the scanning driving unit in FIG. 3.
Figure 5:
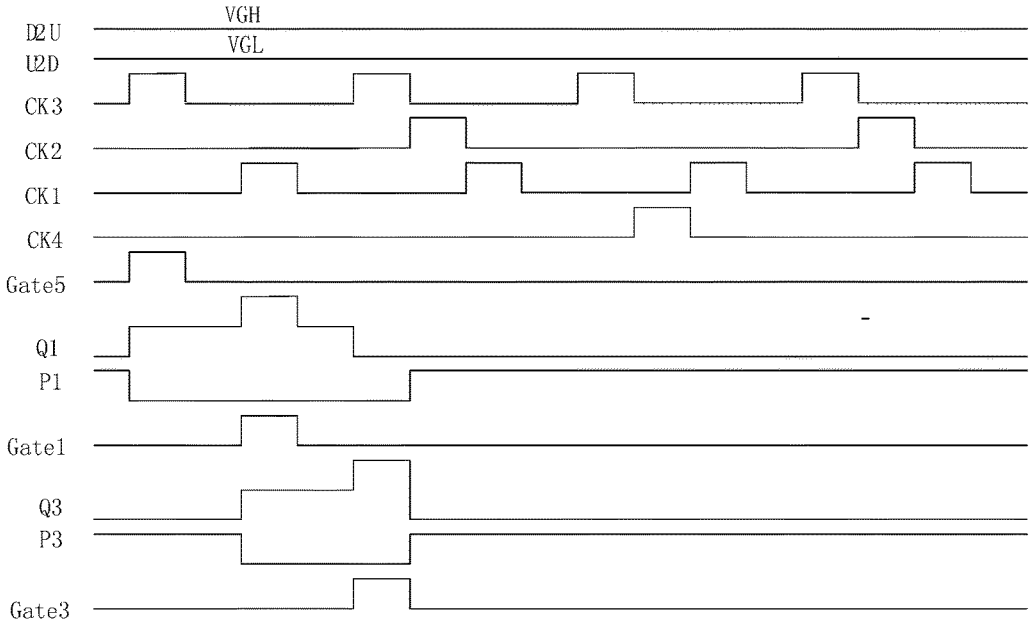
FIG. 5 is a backward-operational timing diagram of the scanning driving unit in FIG. 3.
Figure 6:
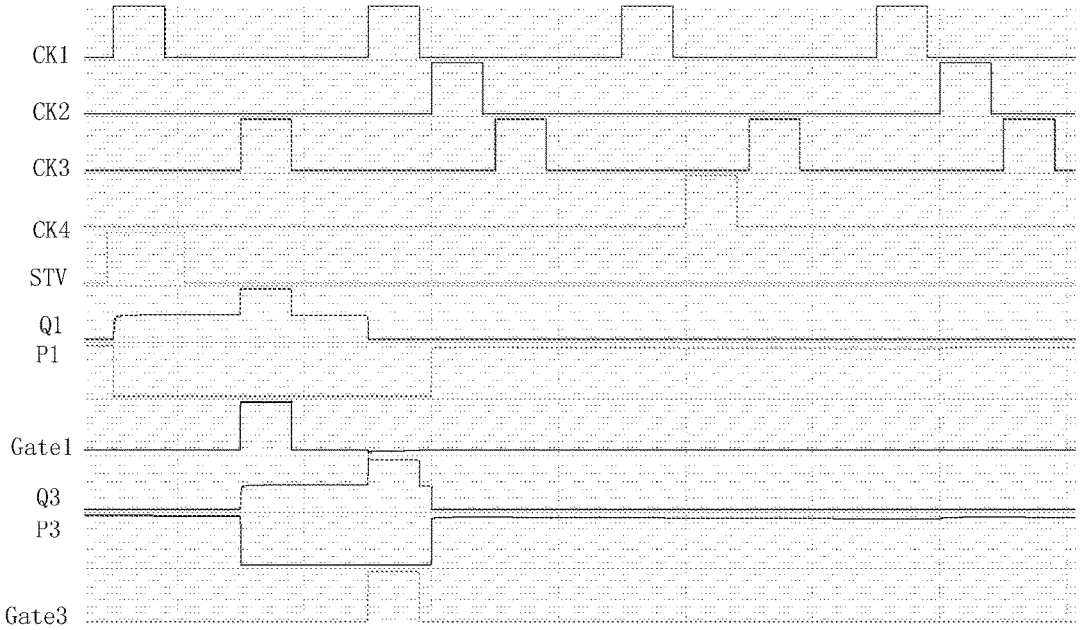
FIG. 6 is a result diagram of the scanning driving unit in FIG. 3 simulated by a first software.
Figure 7:
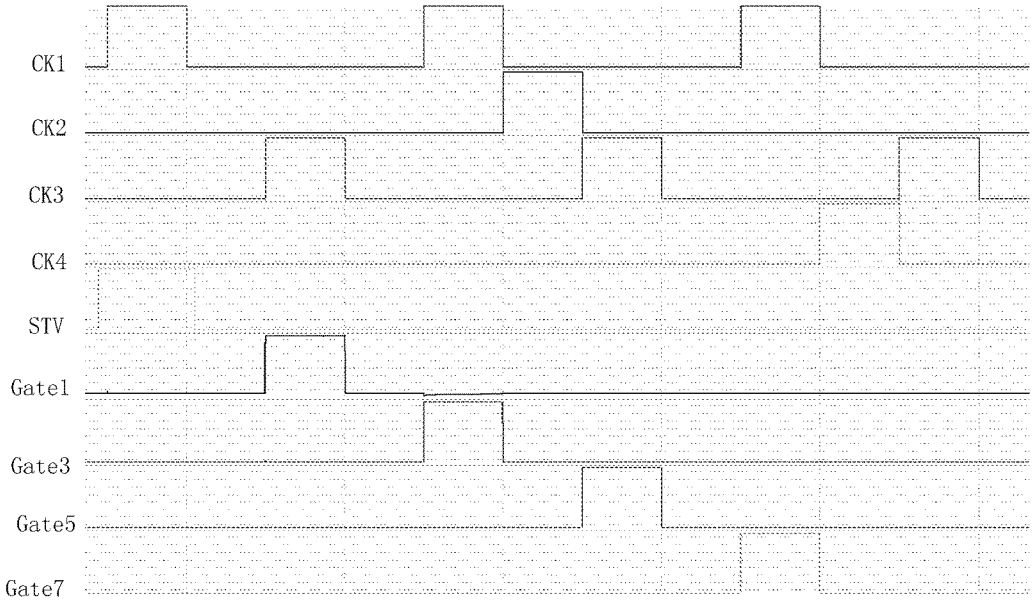
FIG. 7 is a result diagram of the scanning driving unit in FIG. 3 simulated by a second software.

FIG. 3 is a circuit diagram of the scanning driving unit of the scanning driving circuit in accordance with a first embodiment. In the embodiment, only the scanning driving units at the first level is taken as one example to illustrate the claimed invention. As shown in FIG. 3, the scanning driving circuit includes a plurality of scanning driving units connected in a cascade manner. Each of the scanning driving units includes the following components.

A forward-backward scanning circuit 100 is configured for receiving a first scanning control voltage, a second scanning control voltage, driving signals, first clock signals, second clock signals, first scanning driving signals, second scanning driving signals, and down-level scanning driving signals to output forward-backward control signals to control the scanning driving circuit to conduct a forward scanning or a backward scanning.

A first input circuit 200 is configured to receive third clock signals and to receive the forward-backward control signals from the forward-backward scanning circuit 100 so as to output first input signals.

A second input circuit 600 is configured to receive fourth clock signals and to receive the forward-backward control signals from the forward-backward scanning circuit 100 so as to output second input signals.

A pull-down circuit 300 is configured to receive the forward-backward control signals and the first input signals, to output the first pull-down signals, and to pull-down or charge the first pull-down control signal point, or the pull-down circuit 300 is configured to receive the forward-backward control signals and the second input signals, to output the second pull-down signals, and to pull-down or charge the second pull-down control signal point.

A first control circuit 400 is configured to receive the first input signals from the first input circuit 200 and to charge the first pull-up control signal point in accordance with the first input signals, or is configured to receive the first pull-down signals from the pull-down circuit 300 and to pull down the first pull-up control signal point in accordance with the first pull-down signals.

A second control circuit 700 is configured to receive the second input signals from the second input circuit 600 and to charge the second pull-up control signal point in accordance with the second input signals, or is configured to receive the second pull-down signals from the pull-down circuit 300 and to pull down the second pull-up control signal point in accordance with the second pull-down signals.

A first output circuit 500 is configured to receive fourth clock signals and to generate first scanning driving signals in accordance with the fourth clock signals, and the first scanning driving signals are outputted to the first scanning line to drive a pixel cell.

A second output circuit 800 is configured to receive third clock signals and to generate second scanning driving signals in accordance with the third clock signals, and the second scanning driving signals are outputted to the second scanning line to drive the pixel cell.

Specifically, the forward-backward scanning circuit 100 includes a first to sixth controllable transistors (T1-T6), a control end of the first controllable transistor (T1) receives the first scanning control voltage (U2D), a first end of the first controllable transistor (T1) receives the driving signals (STV), a second end of the first controllable transistor (T1) connects to the second end of a second controllable transistor (T2) and the first input circuit 200, a first end of the second controllable transistor (T2) connects to the second scanning line to receive the second scanning driving signals, a control end of the second controllable transistor (T2) connects to a control end of the third controllable transistor (T3) and receives the second scanning control voltage (D2U), a first end of the third controllable transistor (T3) receives the first clock signals, a second end of the third controllable transistor (T3) connects to a second end of the fourth controllable transistor (T4) and the pull-down circuit 300, a first end of the fourth controllable transistor (T4)

receives the second clock signals, a control end of the fourth controllable transistor (T4) connects to a control end of the fifth controllable transistor (T5) and receives the first scanning control voltage (U2D), a first end of the fifth controllable transistor (T5) connects to the first scanning line to receive the first scanning driving signals, a second end of the fifth controllable transistor (T5) connects to a second end of the sixth controllable transistor (T6) and the second input circuit 600, a first end of the sixth controllable transistor (T6) connects to the scanning line at the down level to receive the scanning driving signals from the down level, and a control end of the sixth controllable transistor (T6) receives the second scanning control voltage (D2U).

The first input circuit 200 includes a seventh controllable transistor (T7). A control end of the seventh controllable transistor (T7) receives the third clock signals, a first end of the seventh controllable transistor (T7) connects to the second end of the first controllable transistor (T1) and the second end of the second controllable transistor (T2), a second end of the seventh controllable transistor (T7) connects to the pull-down circuit 300 and the first control circuit 400.

The pull-down circuit 300 includes eighth to fifteenth controllable transistor (T8-T15), a first capacitor (C1), and a second capacitor (C2). A control end of the eighth controllable transistor (T8) connects to the second end of the seventh controllable transistor (T7), a first end of the ninth controllable transistor (T9) and the first control circuit 400, a first end of the eighth controllable transistor (T8) receives turn-off voltage end signals (VGL), a second end of the eighth controllable transistor (T8) connects to a control end of a ninth controllable transistor (T9), a control end of the tenth controllable transistor (T10), a control end of the fourteenth controllable transistor (T14), a control end of the fifteenth controllable transistor (T15), a first end of the thirteenth controllable transistor (T13), a second end of the eleventh controllable transistor (T11), and a first end of the twelfth controllable transistor (T12). A second end of the ninth controllable transistor (T9) connects to the first end of the tenth controllable transistor (T10), the second end of the fourteenth controllable transistor (T14), and the first end of the fifteenth controllable transistor (T15) to receive the turn-off voltage end signals (VGL). The second end of the tenth controllable transistor (T10) connects to the control end of the thirteenth controllable transistor (T13), the second input circuit 600, and the second control circuit 700. The first end of the eleventh controllable transistor (T11) receives turn-on voltage end signals (VGH). The control end of the eleventh controllable transistor (T11) connects to the control end of the twelfth controllable transistor (T12), the second end of the third controllable transistor (T3), and the second end of the fourth controllable transistor (T4). The second end of the twelfth controllable transistor (T12) receives the turn-on voltage end signals (VGH). The control end of the thirteenth controllable transistor (T13) connects to the second input circuit 600, the second control circuit 700, and the second end of the tenth controllable transistor (T10). The second end of the thirteenth controllable transistor (T13) receives the turn-off voltage end signals (VGL). The first end of the fourteenth controllable transistor (T14) connects to the first output circuit 500, the second end of the fifteenth controllable transistor (T15) connects to the second output circuit 800, the first capacitor (C1) connects between the first end and the second end of the eleventh controllable transistor (T11), and the second capacitor (C2) connects between the first end and the second end of the twelfth controllable transistor (T12).

The first control circuit 400 includes a sixteenth controllable transistor (T16). A control end of the sixteenth controllable transistor (T16) receives the turn-on voltage end signals (VGH), a first end of the sixteenth controllable transistor (T16) connects to the second end of the seventh controllable transistor (T7), the control end of the eighth controllable transistor (T8), and the first end of the ninth controllable transistor (T9). A second end of the sixteenth controllable transistor (T16) connects to the first output circuit 500.

The first output circuit 500 includes a seventeenth controllable transistor (T17) and a third capacitor (C3). A control end of the seventeenth controllable transistor (T17) connects to the second end of the sixteenth controllable transistor (T16), a first end of the seventeenth controllable transistor (T17) receives fourth clock signals, a second end of the seventeenth controllable transistor (T17) connects to the first scanning line and the first end of the fourteenth controllable transistor (T14), and the third capacitor (C3) connects between the control end and the second end of the seventeenth controllable transistor (T17).

The second input circuit 600 includes an eighteenth controllable transistor (T18). A control end of the eighteenth controllable transistor (T18) receives the fourth clock signals, a first end of the eighteenth controllable transistor (T18) connects to the second end of the fifth controllable transistor (T5) and the second end of the sixth controllable transistor (T6), a second end of the eighteenth controllable transistor (T18) connects to the control end of the thirteenth controllable transistor (T13), the second end of the tenth controllable transistor (T10), and the second control circuit 700.

The second control circuit 700 includes a nineteenth controllable transistor (T19). A control end of the nineteenth controllable transistor (T19) receives the turn-on voltage end signals (VGH), the first end of the nineteenth controllable transistor (T19) connects to the second end of the tenth controllable transistor (T10), the control end of the thirteenth controllable transistor (T13), and the second end of the eighteenth controllable transistor (T18). A second end of the nineteenth controllable transistor (T19) connects to the second output circuit 800.

The second output circuit 800 includes a twentieth controllable transistor (T20) and a fourth capacitor (C4). A control end of the twentieth controllable transistor (T20) connects to the second end of the nineteenth controllable transistor (T19), a first end of the twentieth controllable transistor (T20) connects to the second scanning line and the second end of the fifteenth controllable transistor (T15). A second end of the twentieth controllable transistor (T20) receives the third clock signals, and the fourth capacitor (C4) connects between the control end and the first end of the twentieth controllable transistor (T20).

In the embodiment, the first to the twentieth controllable transistors (T1-T20) are N-type thin film transistors (TFTs). The control ends, the first ends, and the second ends of the first to the twentieth controllable transistors (T1-T20) respectively correspond to the gate, drain, and the source of the N-type TFTs. In other embodiments, the first to the twentieth controllable transistors (T1-T2) may be transistors of other types as long as the same functions may be accomplished.

Specifically, the first clock signals are the clock signals (CK4), the second clock signals are the second clock signals (CK2), the third clock signals are the third clock signals (CK1), and the fourth clock signals are the fourth clock signals (CK3). The first pull-up control signal point is the pull-up control signal point (Q1), the second pull-up control signal point is the pull-up control signal point (Q3), the first pull-down control signal point is the pull-down control signal point (P1), the second pull-down control signal point is the second pull-down control signal point (P3), the driving signals are the driving signals (STV), and the first scanning line is the scanning line (Gate1), the second scanning line is the second scanning line (Gate3), and the scanning line at the down level is the scanning line at the down level (Gate5).

With respect to the scanning driving circuit, the sequence of receiving the clock signals (CK1) and the clock signals (CK3) for the scanning driving units at the first level remain the same. The sequence of receiving the second clock signals (CK2) and the first clock signals (CK4) has to be interchanged for every other level. For instance, with respect to the scanning driving unit at the first level, the first end of the third controllable transistor (T3) receives the first clock signals (CK4), and the first end of the fourth controllable transistor (T4) receives the second clock signals (CK2). Thus, with respect to the scanning driving units at the second level, the first end of the third controllable transistor (T3) receives the second clock signals (CK2), and the first end of the fourth controllable transistor (T4) receives the first clock signals (CK4).

FIGS. 4-7 are timing diagram and simulation diagrams of the scanning driving circuit in accordance with one embodiment. The operations of the scanning driving circuit in FIGS. 4-7 will be illustrated below, wherein one scanning driving unit at the first level is taken as one example. When a first scanning control voltage (U2D) is at the high level and a second scanning control voltage (D2U) is at the low level, the transistor (T1) and the transistors (T4, T5) are turned on and the scanning driving circuit is in a positive-scanning state. When the third clock signals (CK1) are at the high level, the driving signals (STV) charges the first pull-up control signal point (Q1) via the transistors (T1, T7, and T16). The first pull-up control signal point (Q1) is charged until reaching the high level, and the third capacitor (C3) is maintained at the high level. At the same time, the transistors (T8) is turned on to apply a pull-down control toward the first pull-down control signal point (P1), and the first capacitor (C1) is maintained at the low level. At this moment, the ninth controllable transistor (T9) and the fourteenth controllable transistor (T14) are in an off state. When the fourth clock signals (CK3) are at the high level, the scanning line (Gate1) outputs the high level signals to generate the first scanning driving signals. At the same time, the eighteenth controllable transistor (T18) is turned on as the fourth clock signals (CK3) are at the high level. The scanning line (Gate1) outputs the first scanning driving signals to charge the second pull-up control signal point (Q3) via the fifth controllable transistor (T5), the eighteenth controllable transistor (T18), and the 19. The second pull-up control signal point (Q3) is charged until reaching the high level, and the fourth capacitor (C4) is maintained at the high level. At the same time, the thirteenth controllable transistor (T13) is turned on to conduct the pull-down control to the second pull-down control signal point (P3), and the second capacitor (C2) is maintained at the low level. At this moment, the tenth controllable transistor (T10) and the fifteenth controllable transistor (T15) are in the off state. When the clock signals (CK1) of the next period reaches the high level, the scanning driving signals (Gate3) outputs the high level signals to generate the second scanning driving signals. When the third clock signals (CK1) of the second period transit to the low level, the second clock signals (CK2) reach the high level, the eleventh controllable transistor (T11) and the twelfth controllable transistor (T12) are turned on, the pull-down control signal point (P1) and the second pull-down control signal point (P3) are charged until reaching the high level, the first capacitor (C1) and the second capacitor (C2) are maintained at the high level. Afterward, the ninth controllable transistor (T9), the fourteenth controllable transistor (T14), the tenth controllable transistor (T10), and the fifteenth controllable transistor (T15) are turned on. The pull-up control signal point (Q1) and the second pull-up control signal point (Q3) are pulled down to be the low level, the output signals of the scanning line (Gate1) and the second scanning line (Gate3) are pulled down to the low level, and the circuit is in the stable state.

When the first scanning control voltage (U2D) is at the low level and the second scanning control voltage (D2U) is at the high level, the transistors (T1, T3, and T6) are turned on and the scanning driving circuit is in a backward-scanning state. When the fourth clock signals (CK3) are at the high level, the scanning driving signals at the down level (Gate5) charges the second pull-up control signal point (Q3) via the sixth controllable transistor (T6), the eighteenth controllable transistor (T18), and the nineteenth controllable transistor (T19). The second pull-up control signal point (Q3) is charged until reaching the high level, and the fourth capacitor (C4) is maintained at the high level. At the same time, the thirteenth controllable transistor (T13) is turned on to apply the pull-down control to the second pull-down control signal point (P3), and the second capacitor (C2) is maintained at the low level. At the same time, the tenth controllable transistor (T10) and the fifteenth controllable transistor (T15) are in the off state. When the third clock signals (CK1) reach the high level, the second scanning line (Gate3) outputs the high level signals, i.e., the second scanning driving signals. At the same time, the third clock signals (CK1) are at the high level, and the seventh controllable transistor (T7) is turned on. The second scanning driving signals outputted by the second scanning line (Gate3) charges the pull-up control signal point (Q1) via the second controllable transistor (T2), the seventh controllable transistor (T7), and the sixteenth controllable transistor (T16). The pull-up control signal point (Q1) is charged until reaching the high level, and the third capacitor (C3) is maintained at the high level. At the same time, the eighth controllable transistor (T8) is turned on to apply the pull-down control to the pull-down control signal point (P1), and the first capacitor (C1) is maintained at the low level. At the moment, the ninth controllable transistor (T9) and the fourteenth controllable transistor (T14) are in the off state. When the fourth clock signals (CK3) of the next period reach the high level, the scanning line (Gate1) outputs the high level signals, i.e., the first scanning driving signals. When the fourth clock signals (CK3) of the second period transits to the low level, the first clock signals (CK4) reaches the high level signals, the eleventh controllable transistor (T11) and the twelfth controllable transistor (T12) are turned, the pull-down control signal point (P1) and the second pull-down control signal point (P3) are charged until reaching the high level, and the first capacitor (C1), and the second capacitor (C2) are maintained at the high level. Afterward, the ninth controllable transistor (T9), the fourteenth controllable transistor (T14), the tenth controllable transistor (T10), and the fifteenth controllable transistor (T15) are turned on, the pull-up control signal point (Q1) and the second pull-up control signal point (Q3) are pulled down to the low level, the output signals of the first scanning line (Gate1) and the second scanning line (Gate3) are pulled down to the low level, and the circuit is in the stable state. The operations of the scanning driving unit are the same with the above, and thus are omitted hereinafter.

Figure 8:
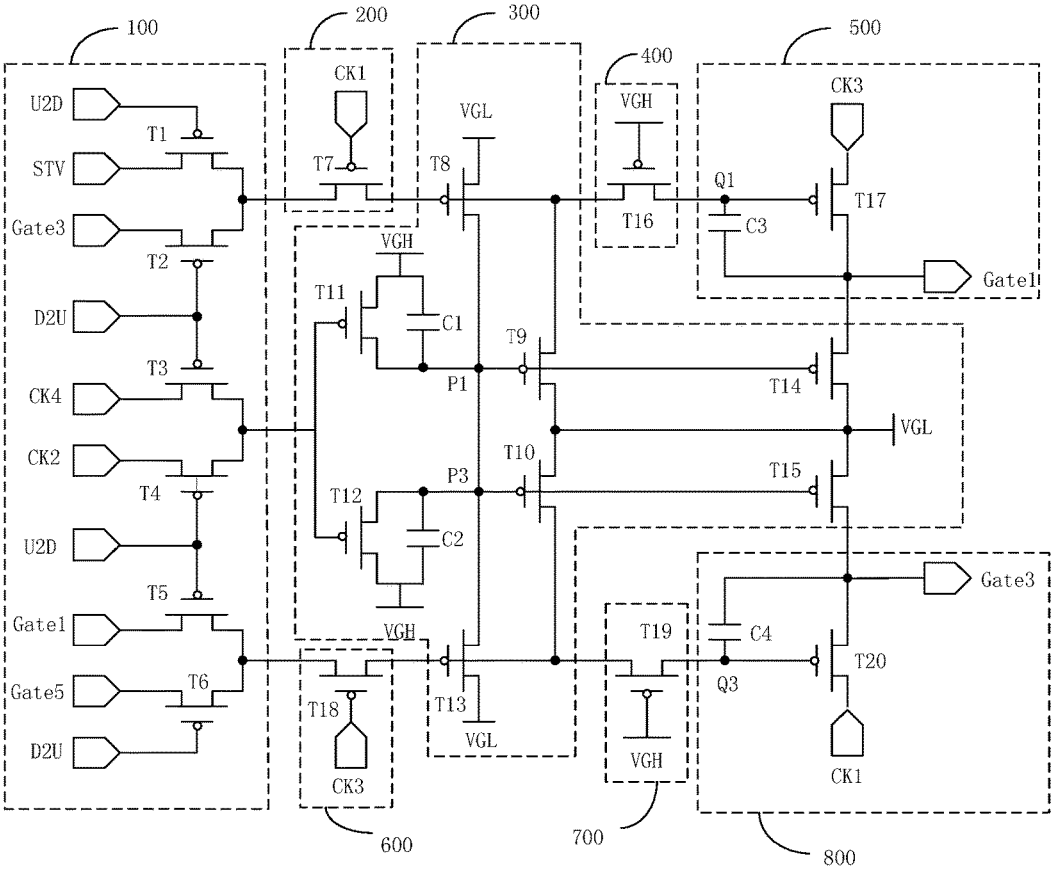
FIG. 8 is a circuit diagram of the scanning driving unit of the scanning driving circuit in accordance with a second embodiment.

FIG. 8 is a circuit diagram of the scanning driving unit of the scanning driving circuit in accordance with a second embodiment. The scanning driving circuit in the second embodiment is different from that in the first embodiment, and the difference resides in that the first controllable transistor (T1) to the twentieth controllable transistor (T20) are P-type TFT, and the control ends, the first ends, and the second ends of the first controllable transistor (T1) to the twentieth controllable transistor (T20) correspond to the gate, the drain, and the source of the P-type TFTs. In other embodiments, the first controllable transistor (T1) to the twentieth controllable transistor (T20) may be TFTs of other types.

In view of the above, the scanning driving circuit may be forward scanned or backward scanned via the forward-backward scanning circuit. The first input circuit, the second input circuit, the first control circuit, and the second control circuit are adopted to charge the first pull-down control signal point and the second pull-down control signal point. In addition, a pull-down circuit is configured to perform the pull-down control to the first pull-down control signal point and the second pull-down control signal point. The first output circuit and the second output circuit outputs the first and the second scanning driving signals to the first and the second scanning lines to drive corresponding pixel cells. In this way, the loading and the power consumption of the clock signals are reduced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A scanning driving circuit, comprising: a plurality of cascaded-connected scanning driving units, and each of the scanning driving unit includes: a forward-backward scanning circuit configured to receive a first scanning control voltage, a second scanning control voltage, driving signals, first clock signals, second clock signals, first scanning driving signals, second scanning driving signals, and down-level scanning driving signals to output forward-backward control signals to control the scanning driving circuit to conduct a forward scanning or a backward scanning;

a first input circuit configured to receive third clock signals and to receive the forward-backward control signals from the forward-backward scanning circuit to output first input signals;

a second input circuit configured to receive fourth clock signals and to receive the forward-backward control signals from the forward-backward scanning circuit to output second input signals;

a pull-down circuit configured to receive the forward-backward control signals and the first input signals, to output first pull-down signals, and to pull-down or charge a first pull-down control signal point, or the pull-down circuit is configured to receive the forward-backward control signals and the second input signals, to output second pull-down signals, and to pull-down or charge a second pull-down control signal point;

a first control circuit configured to receive the first input signals from the first input circuit and to charge the first pull-up control signal point in accordance with the first input signals, or is configured to receive the first pull-down signals from the pull-down circuit and to pull down the first pull-up control signal point in accordance with the first pull-down signals;

a second control circuit configured to receive the second input signals from the second input circuit and to charge a second pull-up control signal point in accordance with the second input signals, or is configured to receive the second pull-down signals from the pull-down circuit and to pull down the second pull-up control signal point in accordance with the second pull-down signals;

a first output circuit configured to receive fourth clock signals and to generate first scanning driving signals in accordance with the fourth clock signals, and the first scanning driving signals are outputted to the first scanning line to drive pixel cells; and a second output circuit configured to receive third clock signals and to generate second scanning driving signals in accordance with the third clock signals, and the second scanning driving signals are outputted to the second scanning line to drive the pixel cells, wherein the forward-backward scanning circuit comprises a first to sixth controllable transistors, a control end of the first controllable transistor receives the first scanning control voltage, a first end of the first controllable transistor receives the driving signals, a second end of the first controllable transistor connects to a second end of a second controllable transistor and the first input circuit, a first end of the second controllable transistor connects to the second scanning line to receive the second scanning driving signals, a control end of the second controllable transistor connects to a control end of the third controllable transistor and receives the second scanning control voltage, a first end of the third controllable transistor receives the first clock signals, a second end of the third controllable transistor connects to a second end of the fourth controllable transistor and the pull-down circuit, a first end of the fourth controllable transistor receives the second clock signals, a control end of the fourth controllable transistor connects to a control end of the fifth controllable transistor and receives the first scanning control voltage, a first end of the fifth controllable transistor connects to the first scanning line to receive the first scanning driving signals, a second end of the fifth controllable transistor connects to a second end of the sixth controllable transistor and the second input circuit, a first end of the sixth controllable transistor connects to the scanning line at a down level to receive the scanning driving signals from the down level, and a control end of the sixth controllable transistor receives the second scanning control voltage, wherein the first input circuit comprises a seventh controllable transistor, a control end of the seventh controllable transistor receives the third clock signals, a first end of the seventh controllable transistor connects to the second end of the first controllable transistor and the second end of the second controllable transistor, and a second end of the seventh controllable transistor connects to the pull-down circuit and the first control circuit, wherein the pull-down circuit comprises eighth to fifteenth controllable transistor, a first capacitor, and a second capacitor, a control end of the eighth controllable transistor connects to the second end of the seventh controllable transistor, a first end of the ninth controllable transistor and the first control circuit, a first end of the eighth controllable transistor receives turn-off voltage end signals, a second end of the eighth controllable transistor connects to a control end of a ninth controllable transistor, a control end of the tenth controllable transistor, a control end of the fourteenth controllable transistor, a control end of the fifteenth controllable transistor, a first end of the thirteenth controllable transistor, a second end of the eleventh controllable transistor, and a first end of the twelfth controllable transistor, a second end of the ninth controllable transistor connects to the first end of the tenth controllable transistor, the second end of the fourteenth controllable transistor, and the first end of the fifteenth controllable transistor to receive the turn-off voltage end signals, the second end of the tenth controllable transistor connects to the control end of the thirteenth controllable transistor, the second input circuit, and the second control circuit, the first end of the eleventh controllable transistor receives turn-on voltage end signals, the control end of the eleventh controllable transistor connects to the control end of the twelfth controllable transistor, the second end of the third controllable transistor, and the second end of the fourth controllable transistor, the second end of the twelfth controllable transistor receives the turn-on voltage end signals, the control end of the thirteenth controllable transistor connects to the second input circuit, the second control circuit, and the second end of the tenth controllable transistor, the second end of the thirteenth controllable transistor receives the turn-off voltage end signals, the first end of the fourteenth controllable transistor connects to the first output circuit, the second end of the fifteenth controllable transistor connects to the second output circuit, the first capacitor connects between the first end and the second end of the eleventh controllable transistor, and the second capacitor connects between the first end and the second end of the twelfth controllable transistor, wherein the first control circuit comprises a sixteenth controllable transistor, a control end of the sixteenth controllable transistor receives the turn-on voltage end signals, a first end of the sixteenth controllable transistor connects to the second end of the seventh controllable transistor, the control end of the eighth controllable transistor, and the first end of the ninth controllable transistor, a second end of the sixteenth controllable transistor connects to the first output circuit, and wherein the first output circuit comprises a seventeenth controllable transistor and a third capacitor, a control end of the seventeenth controllable transistor connects to the second end of the sixteenth controllable transistor, a first end of the seventeenth controllable transistor receives fourth clock signals, a second end of the seventeenth controllable transistor connects to the first scanning line and the first end of the fourteenth controllable transistor, and the third capacitor connects between the control end and the second end of the seventeenth controllable transistor.

2. The scanning driving circuit as claimed in claim 1, wherein the second input circuit comprises an eighteenth controllable transistor, a control end of the eighteenth controllable transistor receives the fourth clock signals, a first end of the eighteenth controllable transistor connects to the second end of the fifth controllable transistor and the second end of the sixth controllable transistor, a second end of the eighteenth controllable transistor connects to the control end of the thirteenth controllable transistor, and the second end of the tenth controllable transistor, and the second control circuit.

3. The scanning driving circuit as claimed in claim 2, wherein the second control circuit comprises a nineteenth controllable transistors, a control end of the nineteenth controllable transistor receives the turn-on voltage end signals, the first end of the nineteenth controllable transistor connects to the second end of the tenth controllable transistor, the control end of the thirteenth controllable transistor, and the second end of the eighteenth controllable transistor, and a second end of the nineteenth controllable transistor connects to the second output circuit.

4. The scanning driving circuit as claimed in claim 3, wherein the second output circuit comprises a twentieth controllable transistor and a fourth capacitor, a control end of the twentieth controllable transistor connects to the second end of the nineteenth controllable transistor, a first end of the twentieth controllable transistor connects to the second scanning line and the second end of the fifteenth controllable transistor, a second end of the twentieth controllable transistor receives the third clock signals, and the fourth capacitor connects between the control end and the first end of the twentieth controllable transistor.

5. The scanning driving circuit as claimed in claim 4, wherein the first to the twentieth controllable transistors are N-type thin film transistors (TFTs), the control ends, the first ends, and the second ends of the first to the twentieth controllable transistors respectively correspond to a gate, a drain, and a source of the N-type TFTs, or the first to the twentieth controllable transistors are P-type TFTs, the control ends, the first ends, and the second ends of the first to the twentieth controllable transistors respectively correspond to a gate, a drain, and a source of the P-type TFTs.

* * * * *